US008222624B2

(12) United States Patent
Yanke et al.

(10) Patent No.: US 8,222,624 B2
(45) Date of Patent: Jul. 17, 2012

(54) SHIELDED DEVICE CONTAINMENT VESSEL

(75) Inventors: Charles H. Yanke, Milwaukee, WI (US); Brian M. Schaber, West Allis, WI (US); Scott H. Yanke, Dousman, WI (US)

(73) Assignee: Vulcan Global Manufacturing Solutions, Inc., Milwaukee, WI (US)

( * ) Notice: Subject to any disclaimer, the term of this patent is extended or adjusted under 35 U.S.C. 154(b) by 288 days.

(21) Appl. No.: 12/556,300

(22) Filed: Sep. 9, 2009

(65) Prior Publication Data

US 2010/0059695 A1 Mar. 11, 2010

Related U.S. Application Data

(63) Continuation of application No. 10/587,992, filed as application No. PCT/US2005/031248 on Sep. 1, 2005, now abandoned.

(51) Int. Cl.
*G21F 5/06* (2006.01)

(52) U.S. Cl. ..... 250/506.1; 250/505.1; 250/507.1; 250/515.1; 250/517.1

(58) Field of Classification Search ..... 250/505.1, 250/506.1, 507.1, 515.1, 517.1; 86/50; 220/646, 220/651, 652
See application file for complete search history.

(56) References Cited

U.S. PATENT DOCUMENTS

| | | | | |
|---|---|---|---|---|
| 3,134,020 | A * | 5/1964 | Shoenfeld | 250/517.1 |
| 3,604,374 | A | 9/1971 | Matson et al. | |
| 3,770,964 | A * | 11/1973 | Backus | 250/506.1 |
| 3,820,435 | A * | 6/1974 | Rogers et al. | 89/1.1 |
| 3,820,479 | A | 6/1974 | Fylling | |
| 4,027,601 | A | 6/1977 | Hickerson | |
| 4,051,763 | A | 10/1977 | Thomanek | |
| 4,100,860 | A | 7/1978 | Gablin et al. | |
| 4,187,758 | A | 2/1980 | Petty | |
| 4,423,683 | A | 1/1984 | Telmo | |
| 4,478,126 | A * | 10/1984 | Holmlund et al. | 86/50 |
| 4,530,813 | A * | 7/1985 | Jacobson | 376/287 |
| 4,638,166 | A * | 1/1987 | Baudro | 250/515.1 |
| 4,660,334 | A | 4/1987 | McCarthy | |
| 4,663,115 | A | 5/1987 | Russell | |
| 4,686,804 | A | 8/1987 | Smith | |

(Continued)

FOREIGN PATENT DOCUMENTS

EP 905501 A2 3/1999

(Continued)

OTHER PUBLICATIONS

European Patent Application 05858097.8 Filed Aug. 7, 2006 Examination Report, Dated Jun. 1, 2011.

(Continued)

*Primary Examiner* — Michael Maskell
(74) *Attorney, Agent, or Firm* — Michael Best & Friedrich LLP

(57) ABSTRACT

A device containment apparatus includes a vessel for storing an explosive device and minimizing dispersal of radioactive material. The vessel includes an outer wall defining an interior area. A first frame supports the vessel and supports a first or outer radiation shield that is spaced from the vessel. A second or inner radiation shield can also be provided, supported adjacent the vessel's outer wall by a second frame that includes upper and lower frame rings. The vessel and the second radiation shield can be generally spherical, while the first frame is substantially rectangular, and the first radiation shield includes substantially planar sides.

10 Claims, 10 Drawing Sheets

U.S. PATENT DOCUMENTS

| | | | | |
|---|---|---|---|---|
| 4,878,415 | A | 11/1989 | Foster, Jr. et al. | |
| 4,889,258 | A | 12/1989 | Yerushalmi | |
| 5,149,494 | A | 9/1992 | Russel | |
| 5,883,394 | A * | 3/1999 | Mussman | 250/515.1 |
| 6,178,991 | B1 | 1/2001 | Schiwek | |
| 6,281,515 | B1 | 8/2001 | DeMeo et al. | |
| 6,341,708 | B1 | 1/2002 | Palley et al. | |
| 6,354,181 | B1 | 3/2002 | Donovan | |
| 6,459,091 | B1 | 10/2002 | DeMeo et al. | |
| 6,644,165 | B1 | 11/2003 | King | |
| 6,828,578 | B2 | 12/2004 | DeMeo et al. | |
| 6,841,791 | B2 | 1/2005 | DeMeo et al. | |
| 6,991,124 | B1 * | 1/2006 | Palley et al. | 220/1.5 |
| 2003/0209133 | A1 | 11/2003 | Greenfield et al. | |
| 2004/0011972 | A1 | 1/2004 | Alishahi | |
| 2004/0158920 | A1 | 8/2004 | Walling | |
| 2005/0211930 | A1 * | 9/2005 | DeMeo et al. | 250/516.1 |
| 2009/0044690 | A1 * | 2/2009 | King | 86/50 |
| 2009/0126555 | A1 * | 5/2009 | Olsson | 86/50 |

FOREIGN PATENT DOCUMENTS

| | | | |
|---|---|---|---|
| GB | 729784 | | 5/1955 |
| JP | 01217300 A | * | 8/1989 |
| WO | 9308361 | | 4/1993 |
| WO | 9607073 | | 3/1996 |
| WO | 2005015119 A1 | | 2/2005 |
| WO | 2007030094 | | 3/2007 |

OTHER PUBLICATIONS

European Patent Application 05858097.8 Filed Aug. 7, 2006 Search Report, Dated Sep. 2, 2008.

NABCO product brochure for NABCO Model 42 and Total Containment Vessel Trailers, publicly known on at least Mar. 8, 2005, four pages, NABCO, Inc.

Database WPI Week 200533. Thomson Scientific, London, GB; AN 2005-320847 & RU 2 251 165 C2 (Rocket Forces Strategic Assignment ACAD) Aug. 27, 2004—XP002491665.

Database WPI Week 200461. Thomson Scientific, London, GB; AN 2004-632540 & RU 2 235 373 C1 (Rocket Forces Strategic Assignment ACAD) Aug. 27, 2004—XP002491666.

EP 10014126 Extended European Search Report date Mar. 20, 2012, 6 pages.

* cited by examiner

SHIELDED DEVICE CONTAINMENT VESSEL

BACKGROUND

The present invention relates to a shielded device containment vessel for storing, transporting and detonating an explosive device and method of operating the same.

Bomb containment vessels are used for transporting and storing explosives, as well as containing an explosion. Typically, containment vessels are spherical or rectangular units having an external shell and a series of reinforcements and shock absorbing material between the shells. Containment vessels contain and absorb an explosion, accidental or intentional, to prevent damage to surrounding persons, environment, or structures. However, if radioactive explosives are stored or detonated within the containment vessel, the containment vessel does not prevent dispersal of radiation from the vessel. Thus, the containment vessel provides no protection to surrounding persons, environment, or structures from radiation exposure.

SUMMARY

In one embodiment, the invention provides a device containment apparatus for storing an explosive device and minimizing dispersal of radioactive material. The device containment apparatus includes a substantially spherical containment vessel for storing an explosive device and a frame supporting the vessel. The vessel defines an interior area and includes a door allowing selective access to the interior area. A radiation shield includes a plurality of radiation shielding panels supported on the frame in spaced relationship with the vessel.

In another embodiment, the invention provides a device containment apparatus for storing an explosive device and minimizing dispersal of radioactive material. The device containment apparatus includes a vessel for storing an explosive device, the vessel including an outer wall defining an interior area. A frame includes a first frame ring and a second frame ring that are positioned at generally opposite ends of the vessel. A radiation shield includes a plurality of overlapping radiation shielding panels supported by the frame and having a shape complementary to an outer wall of the vessel.

In yet another embodiment, the invention provides a device containment apparatus for storing an explosive device and minimizing dispersal of radioactive material. A vessel is included for storing an explosive device. The vessel includes an outer wall defining an interior area. A first frame supports the vessel and includes a base and an upper portion spaced above the base. A second frame includes an upper frame ring and a lower frame ring, the upper and lower frame rings positioned at generally opposite ends of the vessel. A first radiation shield includes a plurality of radiation shielding panels supported on the first frame. A second radiation shield includes a plurality of radiation shielding panels that are supported by the upper and lower frame rings and extend along an outer wall of the vessel. The first radiation shield is positioned radially outward of the second radiation shield so that the first radiation shield is in spaced relationship with the outer wall of the vessel and the second radiation shield.

Other aspects of the invention will become apparent by consideration of the detailed description and accompanying drawings.

Figure 1:
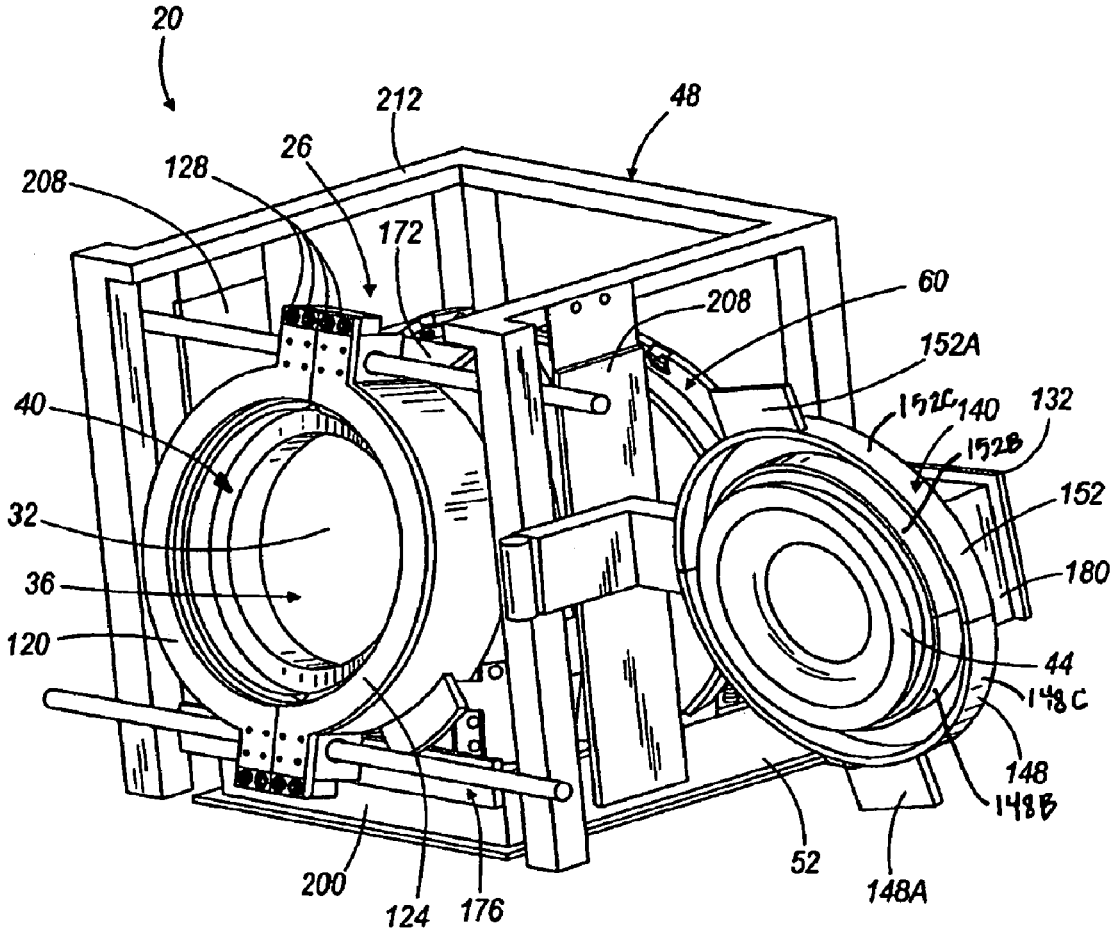
FIG. 1 is a perspective view of one embodiment of a device containment apparatus embodying the invention.

Before any embodiments of the invention are explained in detail, it is to be understood that the invention is not limited in its application to the details of construction and the arrangement of components set forth in the following description or illustrated in the following drawings. The invention is capable of other embodiments and of being practiced or of being carried out in various ways. Also, it is to be understood that the phraseology and terminology used herein is for the purpose of description and should not be regarded as limiting. The use of "including," "comprising," or "having" and variations thereof herein is meant to encompass the items listed thereafter and equivalents thereof as well as additional items. Unless specified or limited otherwise, the terms "mounted," "connected," "supported," and "coupled" and variations thereof are used broadly and encompass both direct and indirect mountings, connections, supports, and couplings. Further, "connected" and "coupled" are not restricted to physical or mechanical connections or couplings.

DETAILED DESCRIPTION

FIGS. 1-5 illustrate a shielded containment system 20 according to one embodiment of the present invention. The shielded containment system 20 is especially suitable for use in the safe disposal and transportation of hazardous materials, including explosive devices (e.g., bombs) and materials, toxic materials, poisonous materials, radioactive materials, biological agents, and chemical agents, and objects having or expected of having one or more such hazardous materials. In a preferred embodiment, the shielded containment system 20 is used for transporting, storing, and/or detonating explosive radioactive materials.

The shielded containment system 20 includes a device containment vessel 24 and a radiation shielding system 26. The containment vessel 24 includes an outer wall 28 (FIG. 2), which at least partially encloses an interior area 32 for receiving explosive devices or materials. In the illustrated embodiment, the containment vessel 24 has a substantially spherical shape. The containment vessel 24 includes an opening 36 through the outer wall 28 for accessing the interior area 32 and a door frame 40, which substantially surrounds the opening 36. The door frame 40 supports a door 44 for movement relative to the door frame 40 between an open position (FIG. 1), in which the door 44 is moved away from or out of the opening 36, and a closed position (FIG. 5), preventing access to the interior area 32 through the opening 36. In one embodiment, the containment vessel 24 includes a latch for securing the door 44 in the closed position and a lock to further secure the door 44 in the closed position and to prevent or limit unauthorized access to the interior area 32. One example of a containment vessel used in the present invention is the Model 42-SCS manufactured by Nabco, Inc. (Pittsburgh, Pa.).

Figure 2:
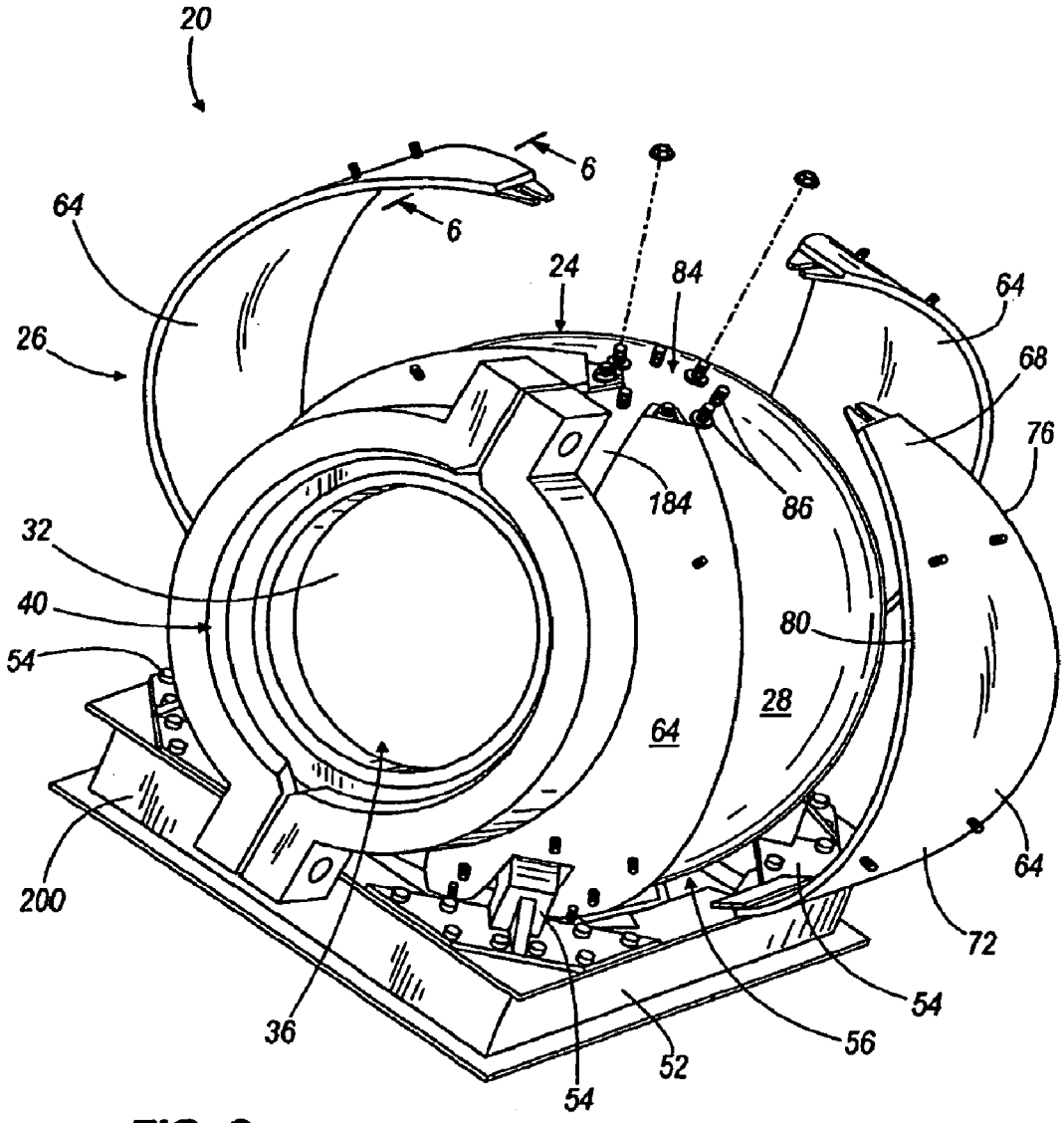
FIGS. 2-5 are perspective views of a partial assembly of the device containment apparatus of FIG. 1.
Figure 3:
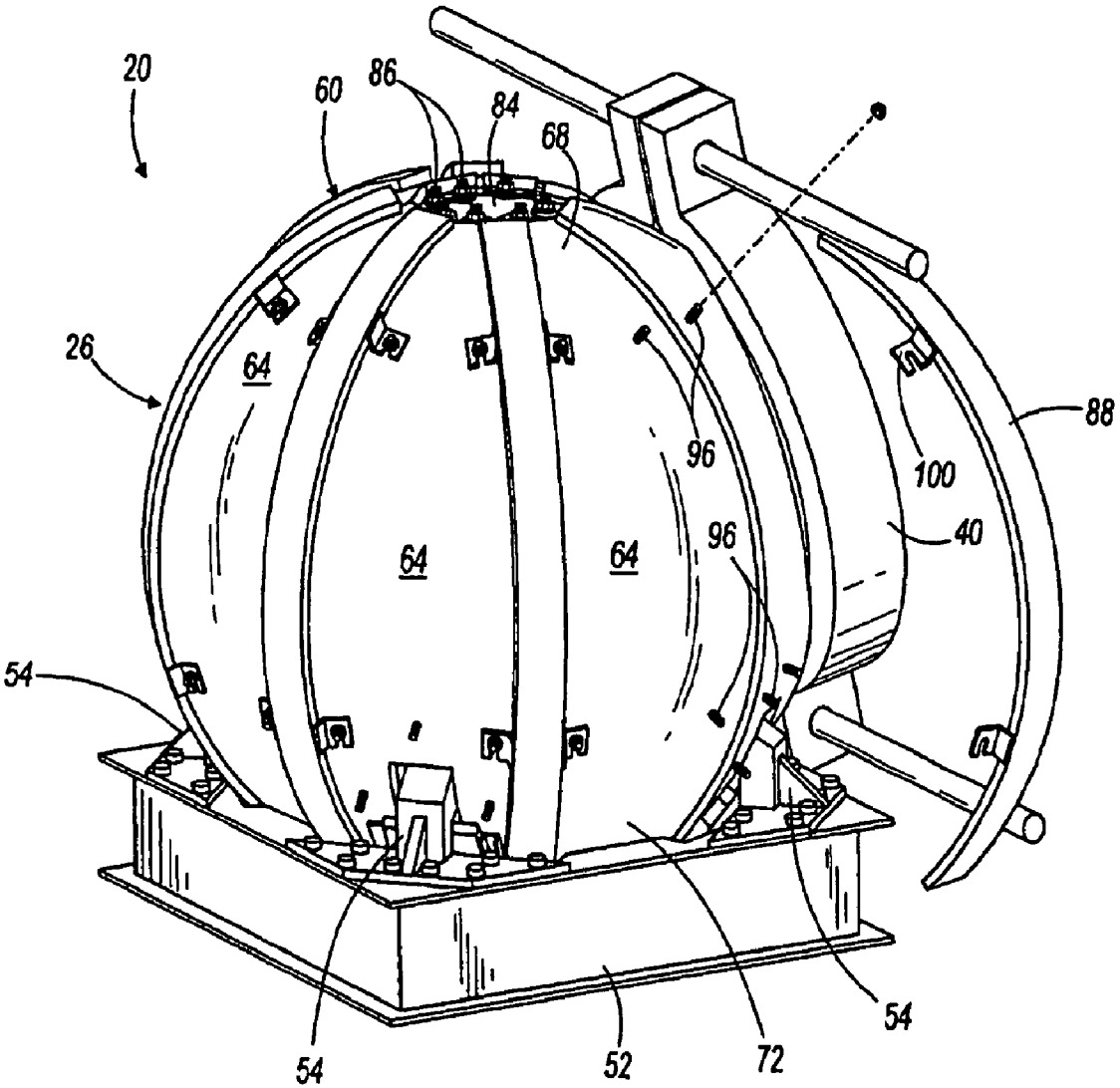

In the illustrated embodiment, the containment vessel 24 is supported by and mounted to a support frame 48 that includes a base 52. Portions of the containment vessel 24 and the radiation shielding system 26 are coupled to and supported by the base 52, and in the illustrated embodiment the underside or bottom portion 56 of the containment vessel 24 is coupled to the base 52 by mounting brackets 54 (FIGS. 2 and 3). The support frame 48 supports the containment vessel 24 in an elevated position above the ground or the floor so that a hand cart, dolly, forklift, or other carrier may more easily lift the containment vessel 24 off of the ground or the floor and move the containment vessel 24 from a first location to a second, remote location. In these embodiments, the support frame 48 may provide openings for receiving portions of a hand cart, dolly, forklift, or other carrier (described below) to facilitate movement of the containment vessel 24.

In another embodiment, the support frame 48 includes a number of wheels or rollers connected to the support frame 48 to facilitate movement of the containment vessel 24 between locations. For example, the support frame 48 may be structured as a trailer so that an operator or a carrier can transport the containment vessel 24 more easily between locations. In some embodiments, the containment vessel 24 may include a dedicated carrier or other non-dedicated carriers may be operable to move the containment vessel 24.

Figure 6:
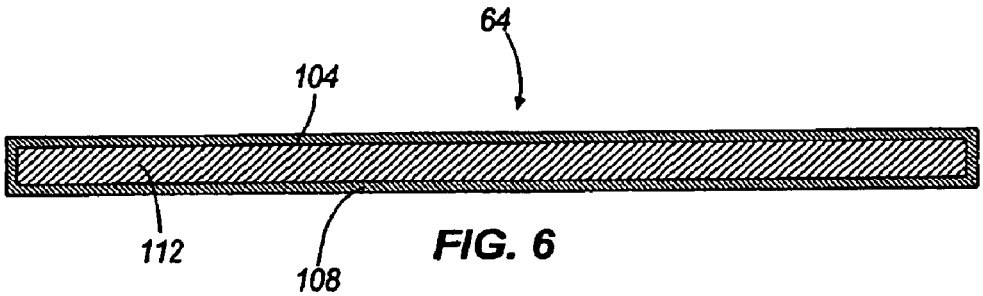
FIG. 6 is a section view of the radiation shield taken along line 6-6 of FIG. 2.

As shown in FIGS. 1 and 2, the radiation shielding system 26 provides a barrier to prevent or minimize dispersal of radiation from radioactive materials stored or detonated within the containment vessel 24 to the surrounding environment. In the illustrated embodiment, the radiation shielding system 26 includes a main vessel shield 60, a door shield system, corner shields 196, and auxiliary shield panels 208 (discussed below). The main vessel shield 60 includes a plurality of panels 64 formed of radiation shielding material (FIGS. 2, 3 and 6). Each panel is shaped to complement a contour of the spherical containment vessel 24 and in particular, a portion of the containment vessel 24 adjacent where the panel 64 is positioned. In the illustrated embodiment, the shape of the panels 64 positioned adjacent the door frame 40 is modified to fit around the door frame 40.

As shown in FIG. 2, each panel 64 includes a first end 68, a second end 72 and first and second side edges 76, 80. The panels 64 are arranged about a circumference of the containment vessel 24 such that the first side edge 76 and the second side edge 80 of adjacent panels 64 abut The first end 68 of the panel 64 is coupled to the base 52 or the bottom portion 56 of the containment vessel 24, and the second end 72 of the panel 64 is coupled to a top portion 84 of the containment vessel 24. For example, the panels 64 may be mounted to fasteners 86 attached to the containment vessel 24, coupled to the containment vessel 24 at attachment points (not shown) welded to the outer wall 28, or the like. In one embodiment, there is an air gap between the outer wall 28 of the containment vessel 24 and the panels 64 to provide a tolerance between the two.

Figure 4:
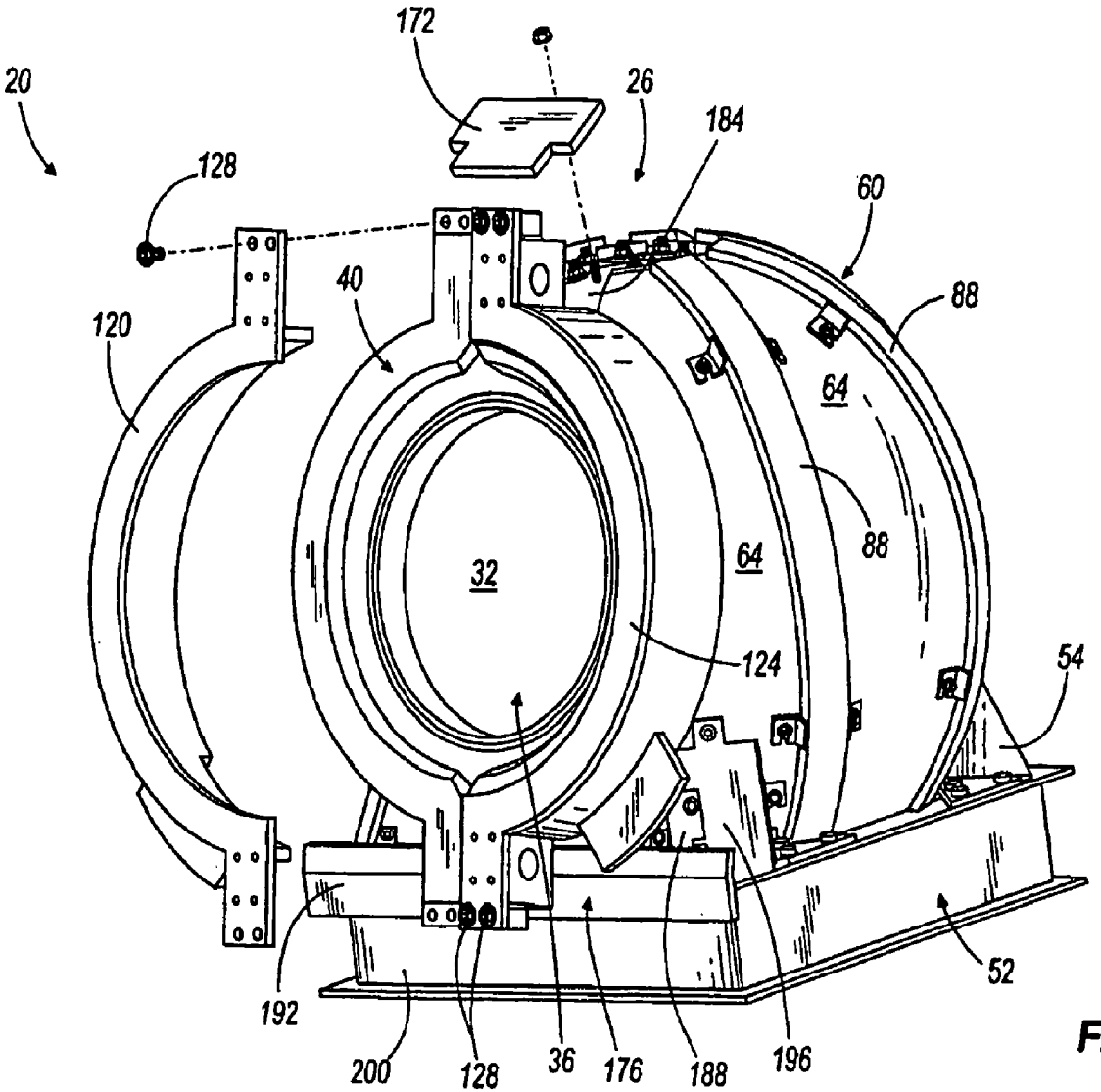
Figure 5:
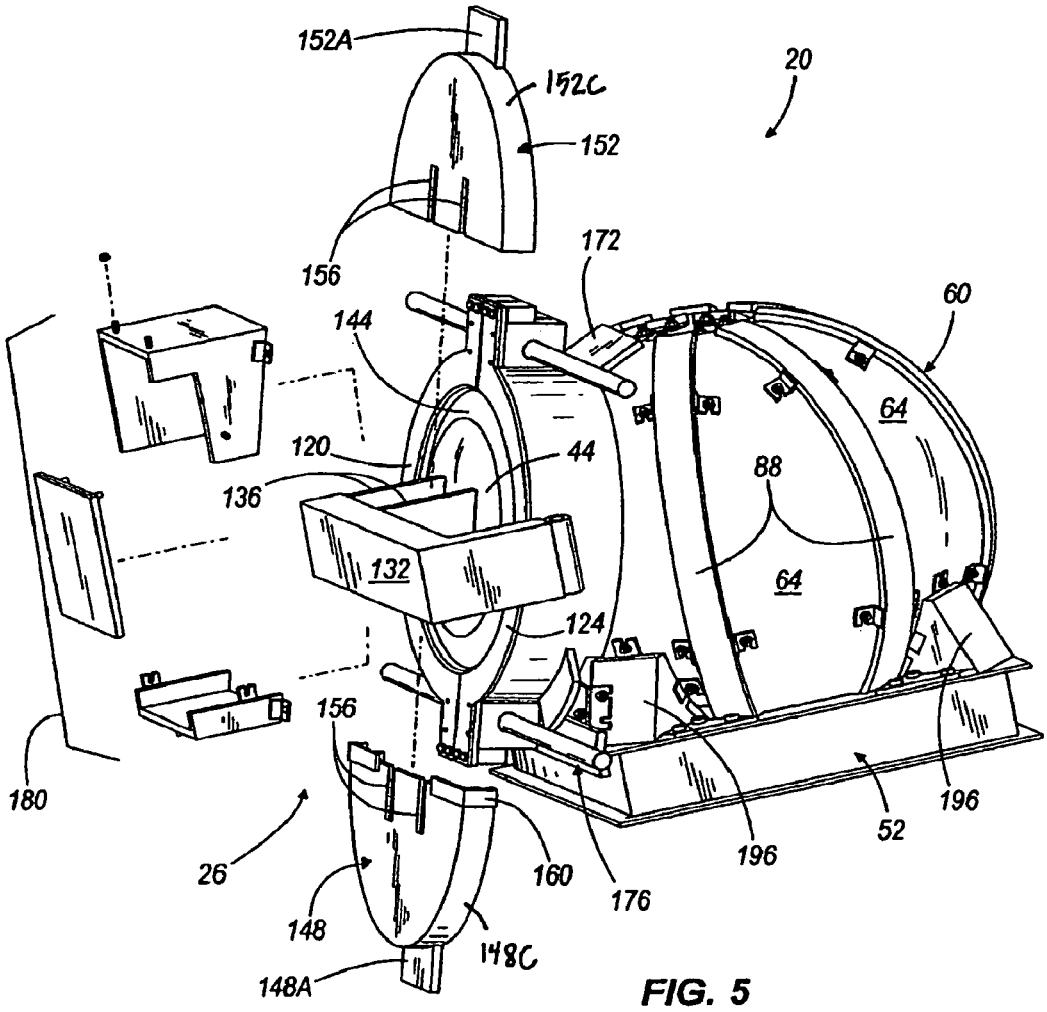

The main vessel shield 60 also includes a plurality of seam plates 88 (FIGS. 3-5). Each seam plate 88 is positioned over a seam (not shown) between adjacent panels 64 and is coupled to the adjacent panels 64. The seam plates 88 are shaped to complement the contour of the adjacent panels 64 and the spherical containment vessel 24. The seam plate 88 overlaps the adjacent panels 64 to prevent line-of-sight radiation exposure, or exposure to other hazardous materials, from the containment vessel 24 at the seam. As shown in FIG. 4, fasteners 96 are attached to each panel 64 and the seam plate 88 includes U-shaped brackets 100 for sliding engagement with the fasteners 96. It should be readily apparent to those of skill in the art that other fastener means may be used to couple the seam plates 88 to the panels 64.

FIG. 6 is a section view of a panel 64 of the main vessel shield 60 that shows multiple layers and materials forming the panel 64. In the illustrated embodiment, the panel 64 is formed from two layers of stainless steel plating 104, 108 that are formed or molded around a radiation shielding core 112. In some embodiments, the core 112 includes or is formed from lead. However, in other embodiments, the core 112 includes or is formed from other radiation shielding materials, such as tungsten. The seam plate 88 is formed from two layers of stainless steel plating formed or molded around a radiation shielding core as well.

The radiation shielding core 112 has a thickness sufficient to contain radiation in the interior area 32 of the containment vessel 24 and prevent radiation or hazardous materials dispersal to the atmosphere. In one embodiment, the core 112 has a thickness of about 0.25 to about 0.8 inches, however, it should be readily apparent to one of skill in the art that the thickness of the core 112 is proportional to the level of shielding required.

In other embodiments, the main vessel shield 60 is manufactured from or includes other materials, including plastics, other synthetic materials, ceramics, fiberglass, iron, and the like, which comprise a radiation shielding material or encase a radiation shielding core. In these embodiments, the main vessel shield 60 is molded (e.g., injection molded) from a plastic material or the main vessel shield 60 is manufactured in any other manner, such as by casting, stamping, machining, bending, pressing, extruding, or other manufacturing operations. In still another embodiment, the radiation shielding core 112 is coated with a protective layer, such as plastic, ceramic, or other synthetic materials. In addition, the main vessel shield may be formed from at least one lead wool blanket, which may be encased, that is positioned adjacent the containment vessel 24.

In embodiments such as the illustrated embodiment of FIGS. 1-5 having stainless steel plating and a core, the steel plating absorbs and contains explosions, minimizing the potential dangers of objects contained in the interior area 32. The steel plating also protects objects contained in the interior 32 area from impacts and environmental damage during storage and transportation of the objects. In these embodiments, the core 112 operates to absorb and contain explosions and to protect the environment external to the containment vessel 24 from hazardous materials within the interior area 32, including radiation. The core 112 also provides radiological insulation to contain or minimize the dispersion of potential harmful radiological or nuclear materials contained in the interior area 32, during transport, storage or detonation of the explosives.

In embodiments having multiple layers and/or being formed of multiple sheets, the layers and/or sheets are welded together. Alternatively, the layers and/or sheets are secured together by threaded fasteners, rivets, pins, clamps, or other fasteners, by snap fits, inter-engaging elements, adhesive or cohesive bonding material, by brazing, or soldering, and the like. In one embodiment, the main vessel shield 60 is formed from a single continuous sheet rather than multiple panels and seam plates.

In some embodiments, the main vessel shield 60 includes a seal including radiation shielding material, which is positioned between the shield 60 and the outer wall 28 of the containment vessel 24 to prevent radiological materials or other hazardous materials from leaking out of the interior area 32 between the shield 60 and the outer wall 28. In these embodiments, the seal can include interlocking or overlapping protrusions, panels, or tabs. In other embodiments, the seal can include one or more elastic and/or insulating elements positioned between the shield 60 and the outer wall 28 of the containment vessel 24.

As can be seen in FIGS. 2-4, the panels 64 are arranged such that the top portion 84 and the bottom portion 56 of the containment vessel 24 remain exposed, which does reduce the weight of the radiation shielding system 26. It should be readily apparent to one of skill in the art that in further embodiments no portions of the containment vessel 24 are exposed, either the top or bottom portion 84, 56 is exposed, or other portions of the containment vessel 24 may be exposed. For example, in one embodiment, radiation shielding panels are positioned at the top and bottom exposed portions 84, 56 of the containment vessel 24 to completely enclose the containment vessel 24.

As shown in FIGS. 1, 4 and 5, the radiation shielding system 26 includes a door shield system for containing and minimizing radiation emissions from the interior area 32 of the containment vessel 24 at areas adjacent the opening 36, the door frame 40 and the door 44. The door shield system includes a pair of radiation shielding frame sleeves 120, 124 configured and adapted for covering external surfaces of the door frame 40. In FIG. 4, frame sleeve 120 is shown attached to the door frame 40 and frame sleeve 124 is shown detached from the door frame 40. The frame sleeves 120, 124 are attached to the door frame 40 with threaded fasteners 128, however, it should be readily apparent that other fastener means may be used, such as rivets, pins, clamps, or other fasteners, by snap fits, inter-engaging elements, adhesive or cohesive bonding material, by brazing, or soldering, and the like.

Each frame sleeve 120, 124 is formed or molded to complement the contour of the door frame 40. The frame sleeves 120, 124 cover, or encase, external surfaces of the door frame 40 to contain or minimize radiation within the interior area 32 from traveling to the external environment through the door frame 40 or areas between the door frame 40 and the adjacent panels 64. As shown in FIGS. 4 and 5, the frame sleeves 120, 124 overlap a portion of the adjacent panels 64 to prevent line-of-sight radiation exposure from between the door frame 40 and the panel 64. In a further embodiment, the frame sleeves 120, 124 include fewer of more components, for example, a single sleeve is configured for covering the door frame 40.

In the closed position, the door 44 is received by the opening to prevent access to the interior area 32. As shown in FIG. 5, an arm 132 pivotally connected to the support frame 42 supports the door 44 and a pair of brackets 136 connect the door 44 to the arm 132. The door shield system includes a door shield 140 for covering an external surface of the door 44, and preventing or minimizing radiation emissions from the interior area 32 of the containment vessel 24 through the door 44 and a seam 144 between the door 44 and the door frame 40. The door shield 140 has a size sufficient to cover the door 44 and the door frame 40 of the containment vessel 24.

The door shield 140 includes a pair of substantially semicircular shield portions 148, 152 that are coupled to the door 44 of the containment vessel 24. Each shield portion 148, 152 includes a pair of notches 156 such that when the door shield 140 is attached to the door 44, the notches 156 fit around the brackets 136. Further, each shield portion 148, 152 includes a radially extending flange 148A, 152A positioned to cover a seam between the two frame sleeves 120, 124 coupled to the door frame 40. Each shield portion 148, 152 includes an inner band 148B, 152B spaced radially inward from an outer perimeter 148C, 152C of the respective shield portion 148, 152. The inner bands 148B, 152B and the outer perimeters 148C, 152C fit between an inner edge of the door frame 40 and an outer edge of the door frame 40 to prevent line-of-sight radiation through the door frame 40. In the illustrated embodiment, the lower shield portion 148 includes a flange 160 for covering a seam between the two door shield portions 148, 152. In a further embodiment, the door 44 is formed from a radiation shielding material, such as tungsten, lead or the like, therefore, eliminating the need for a door shield, although supplemental shields may be used to provide shielding at seams of the containment vessel 24.

The door shield system also includes an upper shield 172, a lower shield 176 and a door mount shield 180. As shown in FIG. 4, the upper shield 172 is positioned over an upper exposed area 184 of the containment vessel 24 behind a top portion of the door frame 40 and between the two panels 64 positioned adjacent the door frame 40. The upper shield 172 prevents or minimizes radiation dispersal to the external environment through the upper exposed area 184. The upper shield 172 attaches to the outer wall 28 of the containment vessel 24. It should be readily apparent to those of skill in the art that other upper shield configurations may be used to cover the exposed area 184 behind the door frame 40 and between the two panels 64 positioned adjacent the door frame 40.

As shown in FIG. 4, the lower shield 176 includes a first shield portion 188 and a second shield portion 190 positioned over a lower exposed area (not shown) at the bottom portion 56 of the containment vessel 24 and between the panels 64 positioned adjacent the door frame 40. The first shield portion 188 of the lower shield 176 extends between and is coupled to two front corner shields 196 (discussed below). The first shield portion 188 covers a portion of the exposed area behind a bottom portion of the door frame 40 and between the two front corner shields 196. The second shield portion 192 is coupled to the first shield portion 188 and extends downward from the first shield portion 188 (FIG. 4) and over a portion of a front face 200 of the base 52. The second shield portion 192 covers a portion of the exposed area behind the bottom portion of the door frame 40 and between the first shield portion 188 and the base 52. It should be readily apparent to those of skill in the art that other lower shield configurations may be used to cover the exposed area behind the door frame 40 and between the two panels 64 positioned adjacent the door frame 40. For example, in one embodiment a radiation shielding plate is mounted to the front face 200 of the base 52.

As illustrated by FIGS. 1 and 5, the door mount shield 180 encloses the door brackets 136 and a portion of the arm 132 to prevent or minimize radiation emissions from the interior area 32 through seams between the door shield portions 148, 152 and the brackets 136. It should be readily apparent to those of skill in the art that the door mount shield 180 may include any number of shield portions.

In a preferred embodiment, the shield portions of the door shield system are formed by a radiation shielding core encased within stainless steel plating. In further embodiments, the shield portions are formed from any number of the materials and layers discussed above with respect to the main vessel shield 60.

As illustrated in FIGS. 1, 4 and 5, the radiation shielding system 26 includes four corner shields 196 for preventing or minimizing radiation emissions from the containment vessel 24 through openings where the containment vessel 24 is attached to the base 52. As seen in FIGS. 2 and 3, the containment vessel 24 is attached to the base 52 by mounting brackets 54. The panels 64 of the main vessel shield 60 are configured to fit around the mounting brackets 54, which leaves openings to the outer wall 28 of the containment vessel 24. Each corner shield 196 is positioned to cover one mounting bracket 54 and overlap the adjacent panels 64. Although the mounting brackets 54 and corner shields 196 are positioned in the four corners of the base 52, in further embodiments, fewer or more mounting brackets 54 and corner shields 196 may be used and positioned in alternate positions around the circumference of the containment vessel 24. In a preferred embodiment, the corner shields 196 are formed by a radiation shielding core encased within stainless steel plating. In further embodiments, the corner shields 196 are formed from any number of the materials and layers discussed above with respect to the main vessel shield 60.

As shown in FIG. 1, the radiation shielding system 26 includes auxiliary shield panels 208 mounted to the support frame 48 of the containment vessel 24. The auxiliary shield panels 208 prevent or minimize radiation emissions from radioactive materials within the interior area 32 of the containment vessel 24 through a seam between the panels 64 of the main vessel shield 60 and the frame sleeves 120, 124 of the door shield system. Each auxiliary shield panel 208 is mounted to the support frame 48 and extends between an upper frame portion 212 to the base 52 adjacent an exposed area to be covered. In a preferred embodiment, the auxiliary shield panels 208 are formed by a radiation shielding core encased within stainless steel plating. In further embodiments, the auxiliary shield panels 208 are formed from any number of the materials and layers discussed above with respect to the main vessel shield 60.

Figure 7:
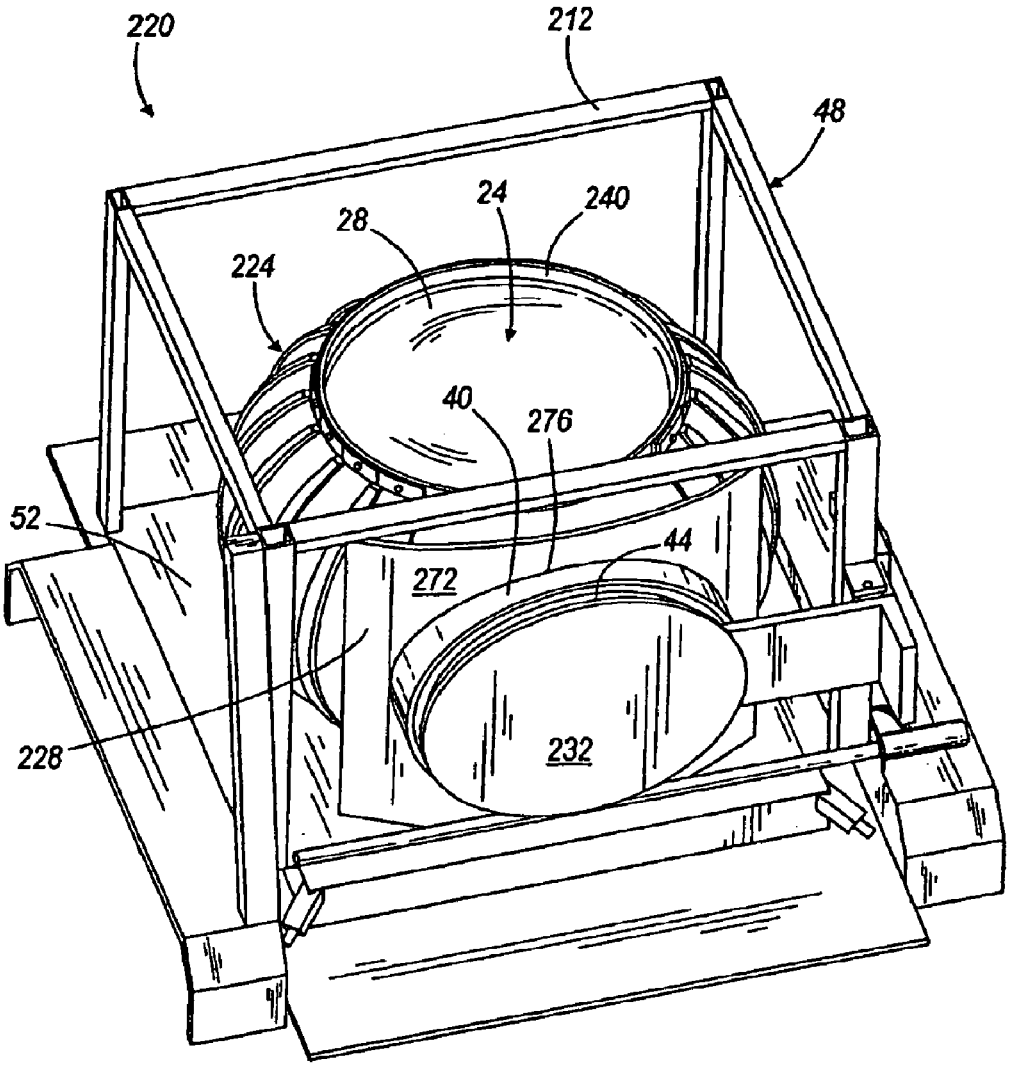
FIG. 7 is a perspective view of another embodiment of a device containment apparatus embodying the invention.
Figure 8:
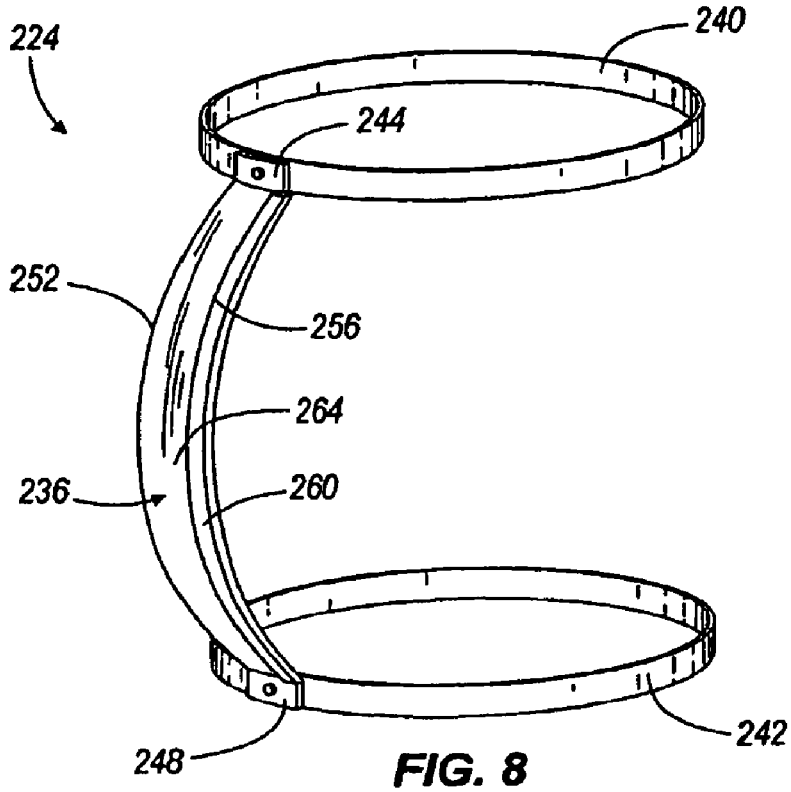
FIG. 8 is a perspective view of a partial assembly of the device containment apparatus of FIG. 6, showing a plate member.
Figure 9:
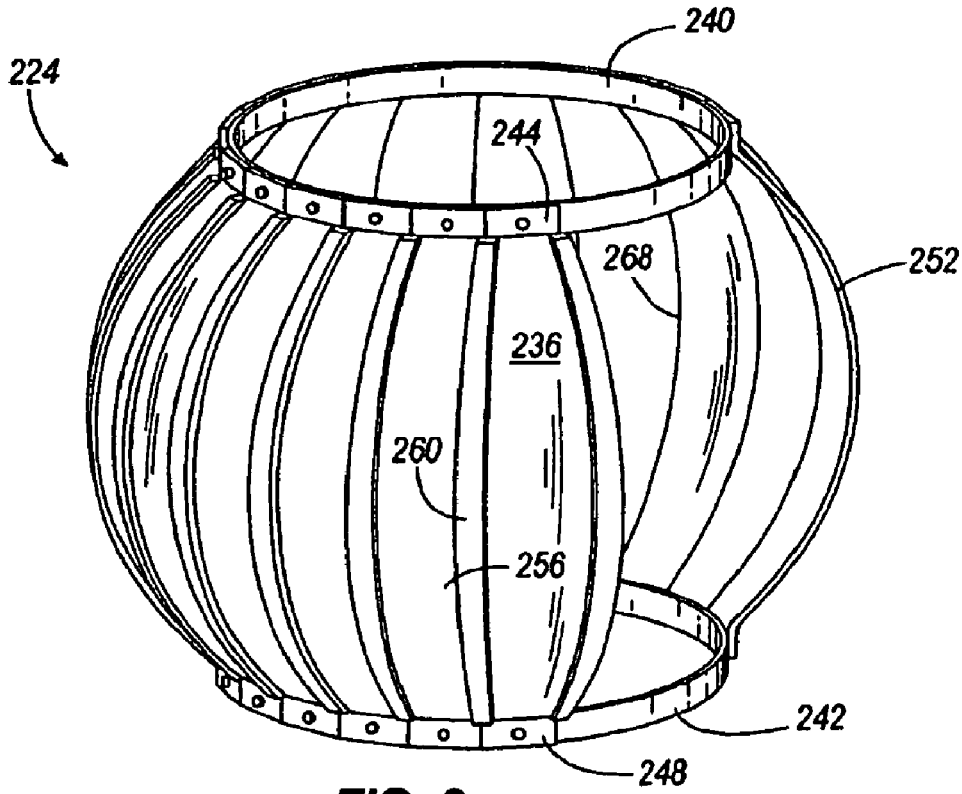
FIG. 9 is a perspective view of a partial assembly of the device containment apparatus of FIG. 6, showing a plurality of plate members.

FIGS. 7-9 illustrate another embodiment of a shielded containment system 220 embodying the invention, in which like features with the embodiment shown in FIGS. 1-5 are identified by the same numerals. The shielded containment system 220 includes the device containment vessel 24 and a radiation shielding system. The containment vessel 24 is supported by and mounted to the support frame 48 that includes the base 52. The containment vessel 24 includes the outer wall 28, which at least partially encloses an interior area (not shown) for receiving explosive materials. In the illustrated embodiment, the containment vessel 24 has a substantially spherical shape. The containment vessel 24 includes the opening 36 through the outer wall 28 for accessing the interior area and the door frame 40, which substantially surrounds the opening 36. The door frame 40 supports the door 44 for movement relative to the door frame 40 between an open position in which the door 44 is moved away from or out of the opening 36, and a closed position (shown in FIG. 7), preventing access to the interior area through the opening 36.

The radiation shielding system includes a main vessel shield 224, a door frame shield 228 and a door shield 232. The main vessel shield 224 includes a plurality of panels 236 and a pair of frame rings 240, 242 mounted to the containment vessel 24 for coupling the panels 236 thereto. FIGS. 8 and 9 illustrate construction of the main vessel shield 224. The panels 236 are shaped to complement a contour of the spherical containment vessel 24. Each panel 236 includes a first end 244, a second end 248 and first and second side edges 252, 256. The first end 244 of the panel 236 is coupled to the upper frame ring 240 and the second end 248 of the panel 236 is coupled to the lower frame ring 242. The panels 236 are arranged about a circumference of the containment vessel 24 such that the first edge 252 and the second edge 256 of adjacent panels 236 abut.

Each panel 236 includes a seam plate 260 extending laterally from a top surface 264 of the second edge 256 of the panel 236. The seam plate 260 overlaps the first edge 252 of he adjacent panel 236 and is positioned over a seam 268 between adjacent panels 236. The seam plate 260 prevents line-of-sight radiation dispersal, or dispersal of other hazardous materials, from the containment vessel 24 at the seam 268. In the illustrated embodiment, the seam plate 260 is integrated with the second edge 256 of the panel 236, however, those skilled in the art will recognize that in further embodiments, the seam plate 260 may be a separate piece.

The radiation shielding system includes the door frame shield 228 that absorbs and contains radiation emissions from the interior area of the containment vessel 24 at areas adjacent the opening 36 and the door frame 40 that are not protected by the main vessel shield 224. The door frame shield 228 includes a substantially rectangular plate 272 shaped to complement a contour of the containment vessel 24, and having an opening 276 configured to fit around and abut the door frame 40.

In the illustrated embodiment, the door shield 232 is coupled to the arm 132 of the containment vessel 24 and covers an exterior surface of the door 44 to prevent or minimize radiation emissions from the interior area of the containment vessel 24 at the door and the door frame 40. The door shield 232 has a size sufficient to cover the door 44 and the door frame 40 of the containment vessel 24. In a further embodiment, the door shield 232 is attached directly to the door 44 or the door itself is formed of a radiation shielding material.

As seen in FIGS. 7 and 9, the radiation shield system keeps exposed the top portion 84 and a bottom portion (not shown) of the containment vessel 24. It should be readily apparent to one of skill in the art that in further embodiments no portions of the containment vessel 24 will be exposed or other portions may be exposed. For example, in one embodiment, radiation shielding panels are positioned at the exposed portions of the containment vessel 24.

In a preferred embodiment, each shield component of the radiation shielding system is formed by a radiation shielding core encased within stainless steel plating. In further embodiments, the shield components may be formed from any number of materials and layers discussed above with respect to FIGS. 1-5.

In a preferred embodiment, the shielded containment systems discussed above are factory fabricated and assembled. However, on one embodiment, the radiation shield system is field fabricated and attached to the containment vessel.

Figure 10:
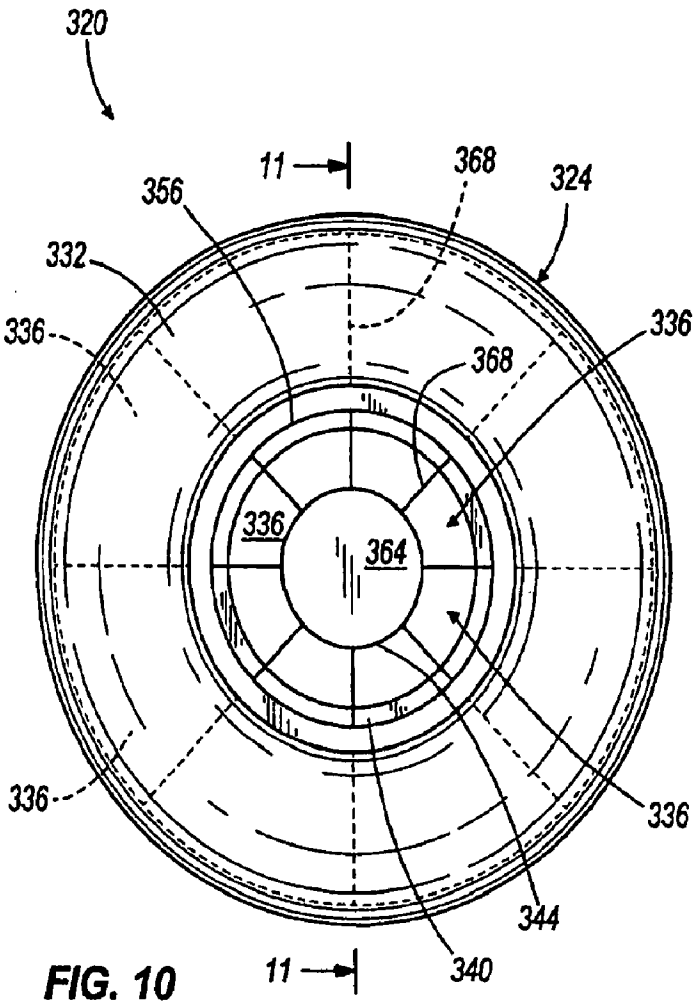
FIG. 10 is an end view of a device containment apparatus illustrating an internal radiation shield.
Figure 11:
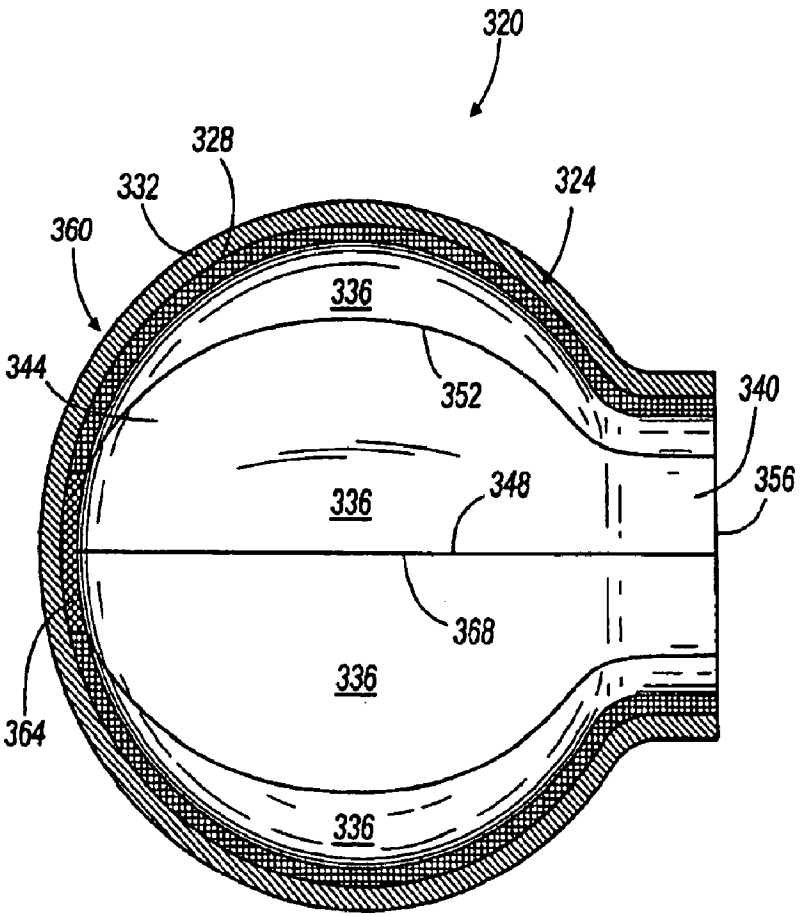
FIG. 11 is a section view of the device containment apparatus of FIG. 10 taken along line 11-11.

FIGS. 10 and 11 illustrate an interior radiation shielding system 320 for a containment vessel 324 having a similar construction to the containment vessel 24 shown in FIGS. 1-5. The radiation shielding system 320 is positioned adjacent an interior surface 328 of an outer wall 332 of the containment vessel 324. The radiation shielding system 320 includes a plurality of radiation shielding panels 336 shaped to complement an internal contour of the spherical containment vessel 324. Each panel 336 includes a first end 340, a second end 344, and first and second side edges 348, 352. The first end 340 of each panel 336 is coupled to the containment vessel 324 adjacent a door opening 356, and the second end 344 is coupled to a rear portion of the containment vessel 324. A radiation shielding end cap 364 is coupled to the containment vessel 324 at the rear portion 360 to cover an open area at the second ends 344 of the panels 336. In the illustrated embodiment, the panels 336 are configured and arranged in a horizontal direction, however, in a further embodiment the panels 336 may be configured and arranged in another direction, such as vertical.

The panels 336 are arranged about the interior circumference of the containment vessel 324 such that the first edge 348 and the second edge 352 of adjacent panels 336 abut. A seam 368 between adjacent panels 336 are tack welded together, however, the panels 336 may also be attached at the seams 368 by other mechanical fastener means known in the art In a further embodiment, seam plates (not shown) are positioned over each seam 368 between adjacent panels 336 to overlap adjacent panels 336 and prevent or minimize line-of-sight radiation dispersal, or dispersal of other hazardous materials, from the containment vessel at the seam 368. In this embodiment, at least a door shield (not shown) would be required to contain radiation in the interior area at the opening 356 of the containment vessel 324.

In one embodiment, the interior radiation shielding system 320 is fabricated and assembled prior to assembly of the containment vessel 324. For example, the containment vessel 324 is formed from two halves of pressed steel welded together to form a sphere. To assemble the radiation shielding system 320, the panels 336 and seam plates are positioned and arranged in each half of the vessel prior to vessel assembly. After the radiation shielding system 320 is assembled, the two halves of the containment vessel 324 are coupled together. The radiation shielding system 320 is incompressible, and after assembly of the containment vessel 324, an explosive is detonated within the interior area to tightly press the panels 336 to the outer wall 332 of the containment vessel 324.

In a preferred embodiment, the panels 336 and other components of the interior radiation shield system 320 are formed by welding together two layers of stainless steel plating with a radiation shielding core therebetween. Alternatively, the panels 336 may be formed by a radiation shielding core encased within stainless steel plating. In further embodiments, the panels 336 and other components of the radiation shielding system 320 may be formed from any number of materials and layers discussed above with respect to FIGS. 1-5.

Figure 12:
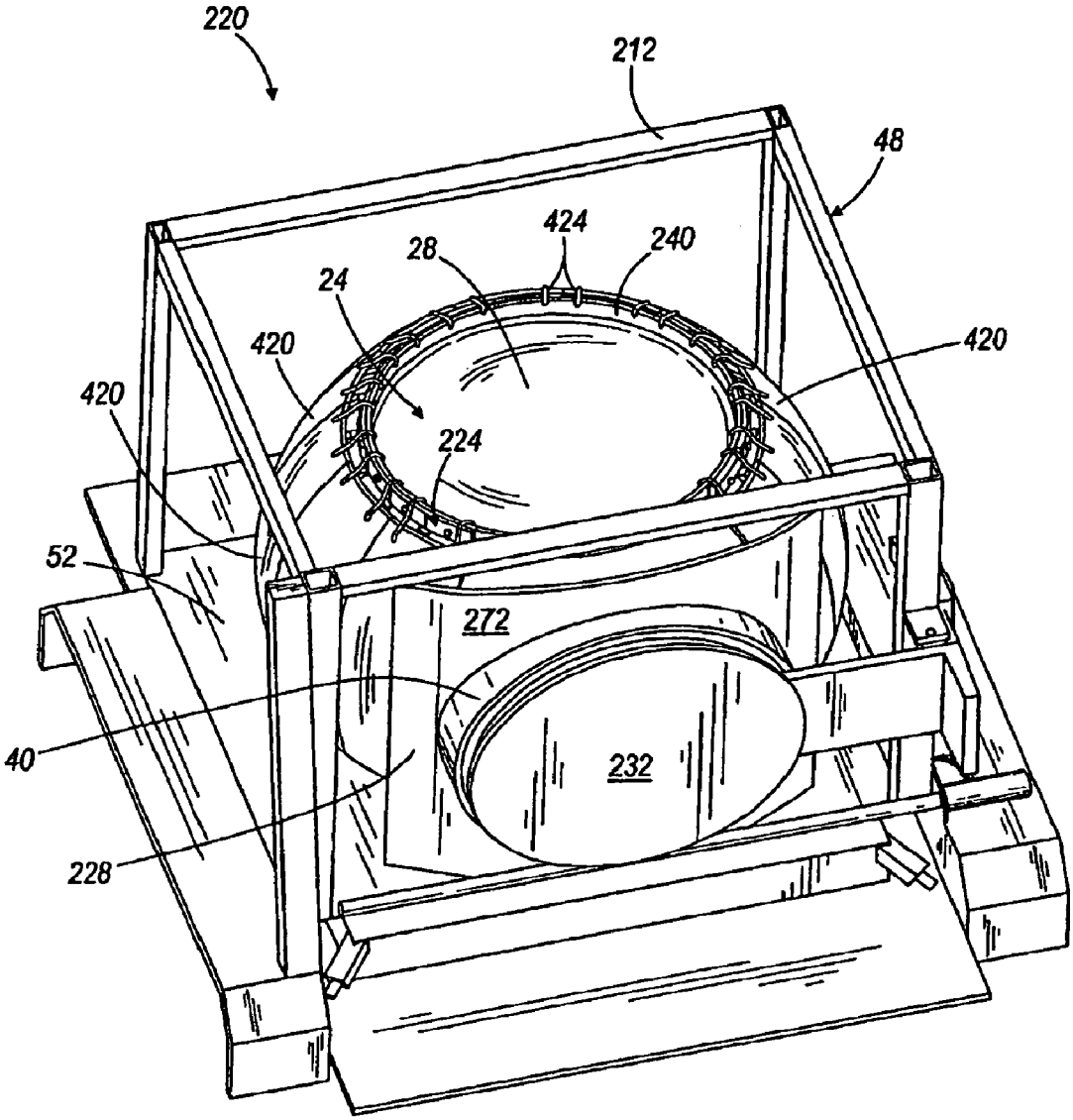
FIG. 12 is a perspective view of another embodiment of the device containment apparatus including a supplemental radiation shield.
Figure 13:
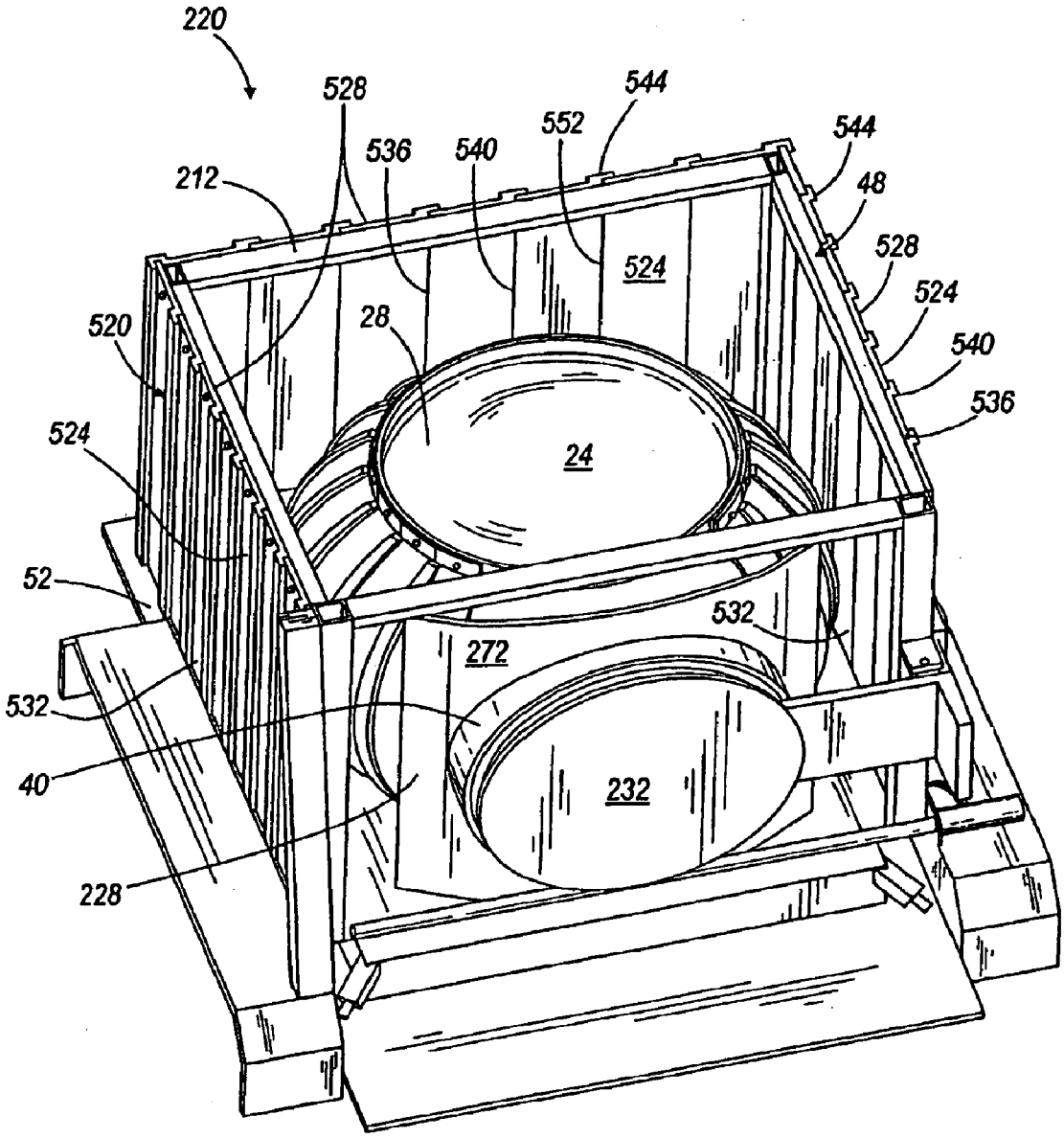
FIG. 13 is a perspective view of another embodiment of the device containment apparatus including a supplemental radiation shield.

FIGS. 12 and 13 illustrate the shielded containment system 220 of FIG. 7 including a supplemental radiation shield. The supplemental radiation shield is attached to the containment vessel 24 or the support frame 48 as needed to provide additional protection against radiation dispersed from the containment vessel 24. For example, when hazardous materials having greater radioactive properties are stored in the containment vessel 24, the supplemental radiation shield is used in addition to the radiation shielding system discussed above. The supplemental radiation shield is either factory mounted to the containment vessel 24, or added on in the field as needed.

FIG. 12 illustrates one embodiment of a supplemental radiation shield 420 including radiation shielding blankets mounted to the upper frame ring 240 of the radiation shielding system and covering the panels 236. In the illustrated embodiment, the supplemental radiation shield comprises multiple blankets, however, in further embodiments the supplemental radiation shield comprises a single blanket arranged around the containment vessel. In a preferred embodiment, the blankets 420 are formed from lead wool rope and are encased in a nylon reinforced PVC covering. It should be readily apparent to those of skill in the art that other radiation shielding materials may be used to form the blankets 420, other materials for the blanket covering may be used, or the covering may be eliminated.

Hooks 424 are hung from the upper frame ring 240 for supporting the blankets 420, although in a further embodiment other fasteners may be used to attach the blankets 420 to the radiation shielding system. In another embodiment, the supplemental radiation shield 420 includes a plurality of radiation shielding panels coupled to the frame rings 240, 242 and covering the panels 236 of the radiation shielding system.

FIG. 13 illustrates another embodiment of the supplemental radiation shield 520 including a plurality of radiation shielding panels 524 mounted to the support frame 48 of the containment vessel 24 and substantially surrounding the containment vessel 24. Each panel 524 includes a first end 528, a second end 532, and first and second side edges 536, 540. The first end 528 of the panel 524 is coupled to the upper portion 212 of the support frame 48 and the second end 532 of the panel 524 extends to the base 52. The panels 524 are arranged about a periphery of the support frame 48 such that the first edge 536 and the second edge 540 of adjacent panels 524 abut.

The second edge 540 of each panel 524 includes a seam plate 544 extending laterally from a top surface of the second edge 540 of the panel 524. When the panels 524 are attached to the support frame 48 and positioned adjacent each other, the seam plate 544 is positioned over a seam 552 between adjacent panels 524 and overlaps the first edge 536 of the adjacent panel 524. The seam plate 544 prevents line-of-sight radiation dispersal, or dispersal of other hazardous materials, from the containment vessel at the seam 552. In the illustrated embodiment, the seam plate 544 is integrated with the second edge of the panel, however, those of skill the art will recognize that in further embodiments, the seam plate 544 may be a separate piece.

In a preferred embodiment, the panels 524 of the supplemental radiation shield system 520 are formed by a radiation shielding core encased within stainless steel plating. In further embodiments, the panels 524 may be formed from any number of materials and layers discussed above with respect to FIGS. 1-5. For example, the panels 524 may each be formed from a lead wool blanket, as shown in FIG. 12, or a single lead wool blanket may be mounted to the support frame 48.

In another embodiment of the radiation shielding system, the shielded containment vessel includes either of the supplemental radiation shields shown in FIGS. 12 and 13 as a primary vessel shield, but does not include the main vessel shield, i.e. the plurality of panels, attached to the containment vessel. In this embodiment, the supplemental radiation shield has a thickness sufficient to prevent or minimize radiation emissions from the interior area of the containment vessel. In yet another embodiment of the shielded containment system, a thermometer or radiation sensor is used to measure radiation levels from the containment vessel, which helps determine whether a supplemental radiation shield is necessary.

In operation, when a hazardous object, such as an explosive device, is located, a shielded containment system is moved to the location of the hazardous object. The door is then moved toward the open position and the hazardous object is inserted into the interior area. In some embodiments, robots, operators, conveyor belts, forklifts, and other product moving devices are also or alternatively used to move hazardous objects into the interior area. Once the hazardous object is positioned in the interior area, an operator moves the door toward the closed position to isolate the hazardous object. In an embodiment having latches, the latch is also moved toward a locked position to secure the door in the closed position.

Once a hazardous object is loaded into the interior area and the door is in the closed position, the containment system is moved to a remote location for safe disposal, storage or inspection. If a hazardous object explodes, leaks, releases harmful agents or materials, or releases radiation while sealed in the interior area, the radiation shielding system and optional supplemental radiation shield contain the harmful agents or materials in the interior area and prevent these harmful agents or materials from escaping to the atmosphere and causing harm to the operator or other people or animals in the area. The outer wall of the containment vessel, the door, and/or the radiation shielding system all help contain the explosion blast.

It should be readily apparent to those of skill in the art that in further embodiments of the radiation shielding panels described above, any number of panels may be used to form the radiation shield (e.g., as few as one or two panels to more than 15), the panels may have other configurations or shapes than those shown in the figures, and the panels may be oriented in other directions (e.g., vertically).

Various features and advantages of the invention are set forth in the following claims.

What is claimed is:

1. A device containment apparatus for storing an explosive device and minimizing dispersal of radioactive material, the device containment apparatus comprising:

a substantially spherical containment vessel for storing an explosive device, the vessel defining an interior area and including a door allowing selective access to the interior area;

a first frame supporting the vessel and further supporting the door to be pivotally coupled to the frame and movable between a closed position preventing access to the interior area and an open position allowing access to the interior area, wherein the frame includes a base and an upper portion spaced a distance above the base;

a first radiation shield including a plurality of radiation shielding panels supported on the first frame and extending between the base and the upper portion of the first frame in spaced relationship with the vessel; and a second frame and a second radiation shield supported by the second frame, the second radiation shield being positioned adjacent an outer wall of the vessel;

wherein the second frame includes a first frame ring and a second frame ring, the first and second frame rings positioned at generally opposite ends of the vessel, and the second radiation shield includes a plurality of overlapping panels, each of the plurality of panels having a first end coupled to the first frame ring, a second end coupled to the second frame ring, and a shape complementary to the outer wall of the vessel.

2. The device containment apparatus of claim 1, wherein the first frame is substantially rectangular.

3. The device containment apparatus of claim 1, wherein the radiation shielding panels of the first radiation shield are arranged on the first frame along substantially planar sides that laterally surround the vessel.

4. The device containment apparatus of claim 1, wherein each of the plurality of panels of the second radiation shield includes a lead wool core encased in a nylon reinforced PVC covering.

5. The device containment apparatus of claim 1, wherein each of the plurality of panels of the second radiation shield includes a radiation shielding core encased within stainless steel plating.

6. The device containment apparatus of claim 1, wherein the plurality of panels of the second radiation shield include integrated seam plates to cover seams where adjacent ones of the plurality of panels meet.

7. The device containment apparatus of claim 1, wherein the first radiation shield includes a door shield covering an exterior surface of the door.

8. The device containment apparatus of claim 7, wherein the door shield is pivotable relative to the first frame.

9. The device containment apparatus of claim 1, wherein each of the plurality of radiation shielding panels of the first radiation shield includes a radiation shielding core encased within stainless steel plating.

10. The device containment apparatus of claim 7, wherein the door shield is coupled to the door to move with the door between the open and closed positions.

* * * * *